US006877241B2

(12) United States Patent
Barr et al.

(10) Patent No.: US 6,877,241 B2
(45) Date of Patent: Apr. 12, 2005

(54) MEASUREMENT OF CURVATURE OF A SUBSURFACE BOREHOLE, AND USE OF SUCH MEASUREMENT IN DIRECTIONAL DRILLING

(75) Inventors: John D. Barr, Cheltenham (GB); Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 4 days.

(21) Appl. No.: 10/064,677

(22) Filed: Aug. 6, 2002

(65) Prior Publication Data

US 2003/0037963 A1 Feb. 27, 2003

(51) Int. Cl.[7] ..... E21B 7/08
(52) U.S. Cl. ..... 33/544; 33/1 H; 33/543
(58) Field of Search ..... 33/544, 1 H, 533, 33/542, 543, 544.1, 544.5, 544.6, 546, 547, 550, 551, 552, 553, 554; 175/61

(56) References Cited

U.S. PATENT DOCUMENTS

| | | | | |
|---|---|---|---|---|
| 3,993,127 A | | 11/1976 | Chepelev et al. | |
| 4,263,552 A | | 4/1981 | Weber | |
| 4,554,982 A | | 11/1985 | Burton | |
| 4,558,750 A | | 12/1985 | Burton et al. | |
| 4,571,695 A | * | 2/1986 | Elton et al. | 33/551 |
| 4,605,076 A | | 8/1986 | Goodhart | |
| 4,646,836 A | | 3/1987 | Goodhart | |
| 4,779,201 A | | 10/1988 | Iizuka et al. | |
| 4,794,534 A | | 12/1988 | Millheim | |
| 4,804,051 A | | 2/1989 | Ho | |
| 4,842,082 A | | 6/1989 | Springer | |
| 4,848,144 A | | 7/1989 | Ho | |
| 4,872,269 A | * | 10/1989 | Sattmann | 33/552 |
| 4,916,824 A | * | 4/1990 | Shimazutsu et al. | 33/551 |
| 4,957,172 A | | 9/1990 | Patton et al. | |
| 4,972,703 A | | 11/1990 | Ho | |
| 5,044,198 A | | 9/1991 | Ho | |
| 5,060,736 A | | 10/1991 | Neff | |
| 5,220,963 A | | 6/1993 | Patton | |
| 5,251,708 A | | 10/1993 | Perry et al. | |
| 5,341,886 A | | 8/1994 | Patton | |
| 5,419,405 A | | 5/1995 | Patton | |
| 5,439,064 A | | 8/1995 | Patton | |
| 5,857,531 A | | 1/1999 | Estep et al. | |
| 5,996,711 A | * | 12/1999 | Ohmer | 175/61 |
| 6,151,791 A | * | 11/2000 | Shimazutsu et al. | 33/552 |
| 6,213,226 B1 | | 4/2001 | Eppink et al. | |
| 6,227,311 B1 | | 5/2001 | Osadchuk | |
| 6,227,312 B1 | | 5/2001 | Eppink et al. | |
| 6,460,630 B2 | | 10/2002 | Ahtola et al. | |

FOREIGN PATENT DOCUMENTS

| | | |
|---|---|---|
| GB | 2 259 316 A | 3/1993 |

* cited by examiner

*Primary Examiner*—Christopher W. Fulton
(74) *Attorney, Agent, or Firm*—Tim Curington; Brigitte Echols

(57) ABSTRACT

The present invention provides methods of measuring downhole the curvature of a borehole and, in a particular application of the invention, using the curvature information as an input component of a bias signal for controlling operation of a downhole bias unit in a directional drilling assembly.

24 Claims, 5 Drawing Sheets

Fig. 1
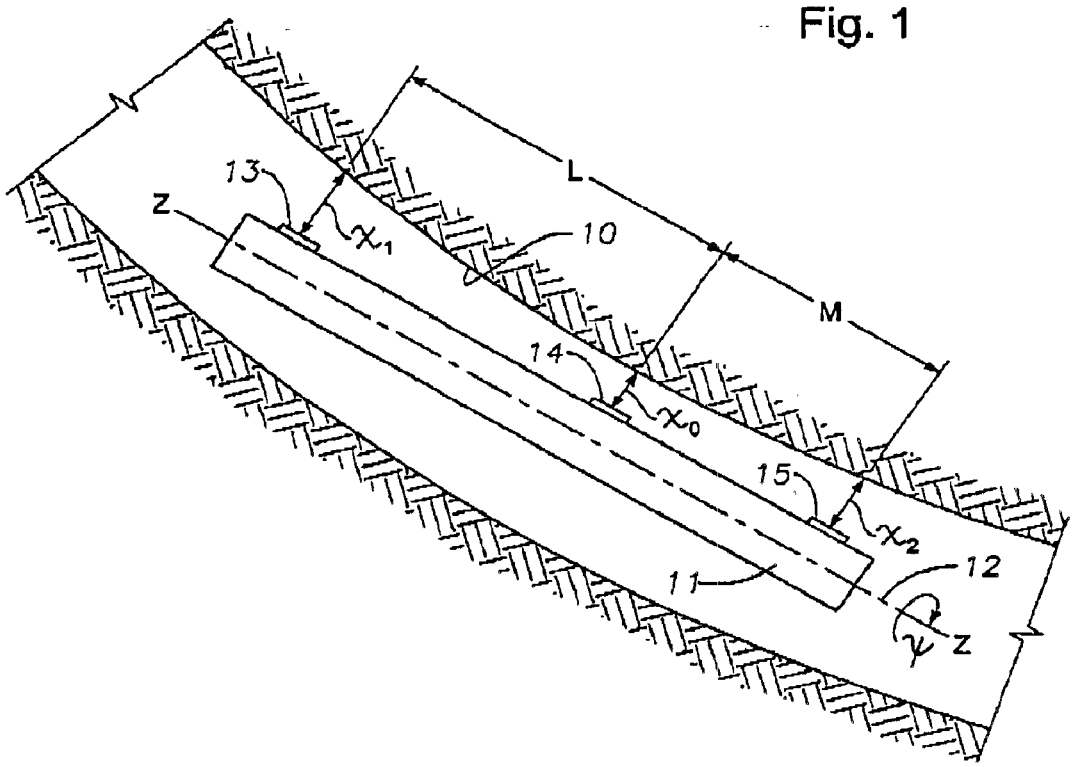
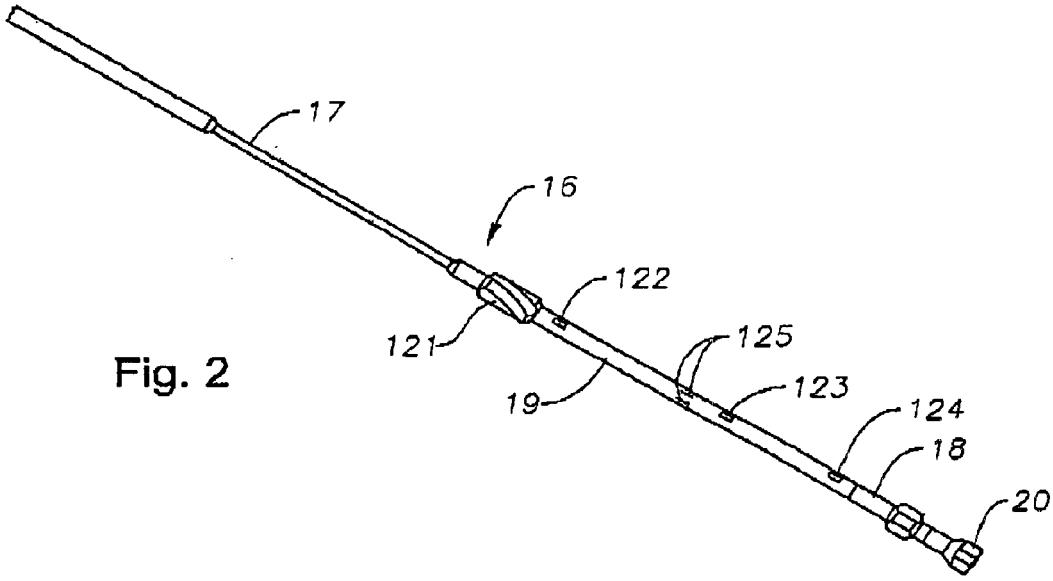
Fig. 2

MEASUREMENT OF CURVATURE OF A SUBSURFACE BOREHOLE, AND USE OF SUCH MEASUREMENT IN DIRECTIONAL DRILLING

BACKGROUND OF INVENTION

1. Field of the Invention

In directional drilling of subsurface boreholes, the downhole drilling assembly which incorporates the drill bit may also incorporate a bias unit which controls operation of the drilling assembly, in response to an input bias signal, to control the direction of drilling. As is well known, the drill string on which the drilling assembly is mounted may be rotated from the surface or the drill bit may be rotated by a downhole motor incorporated in the bottom hole assembly, in which case the drill string is non-rotating.

2. Description of the Related Art

One form of bias unit for controlling the direction of drilling in a rotary drilling system is disclosed in British Patent No. 2259316.

In prior art directional drilling equipment, the direction (i.e. the inclination and azimuth) of a drill collar close to the drill bit is measured. The measured direction is compared at intervals or continuously with a desired direction (which may be input by an operator at the surface or input automatically by a computer program) and the difference between components of the desired direction and of the measured collar direction are calculated and such differences are used to generate appropriate signals to control the bias unit to reduce or minimize the difference. In one method of operation the direction measurements made downhole are sent to the surface by mud pulse telemetry and compared with a desired direction by an operator who then decides on a bias vector to correct the direction. The operator then transmits appropriate signals downhole to command the bias unit.

In an alternative arrangement, in order to respond sooner to disturbances and to economize on scarce telemetry bandwidth, the desired direction can be stored and updated downhole, where it can be compared with the downhole direction measurements.

Typical direction measurements are subject to variable errors or "noise" due, for example, to vibration of the drill collar in the hole, magnetic disturbances, temperature fluctuations, servo and other instrument errors etc. The effect of this noise can be reduced by averaging several measurements of direction taken at successive time intervals. Unfortunately, such averaging necessarily causes delay and phase lag in the control loop, adversely affecting stability of the loop and reducing the gain or sensitivity which can be used in the system. Any attempt to correct the phase lag by phase advance of the directional signals merely brings back the noise. Although stabilizing filters can be optimized, accuracy and performance are still limited by signal noise.

Another possible cause of error is that the direction which is being measured may be the direction of the downhole hardware, and not the direction of the actual borehole itself. The hardware may be inclined with respect to the borehole so that the measured direction is inaccurate.

Another problem is that, when calculating borehole direction, the relevant independent variable is not time, but is the incremental depth along the borehole, that is to say the required direction of a portion of the borehole depends on the location/depth of that part of the borehole and not on time. Although the depth of the borehole generally increases with time, the rate of increase may not be constant. Unfortunately, in most prior art systems information as to the depth of the borehole and the location of the bottom of the borehole is not available downhole.

SUMMARY OF INVENTION

The present invention provides a method of measuring downhole the curvature of a borehole and, in a particular application of the invention, using the curvature information as an input component of a bias signal for controlling operation of a downhole bias unit in a directional drilling assembly.

According to one aspect of the invention there is provided a method of measuring the curvature of a subsurface borehole comprising locating in the borehole an elongate structure having mounted thereon at least three distance sensors spaced apart longitudinally of the borehole, each distance sensor being adapted to produce an output signal corresponding to a distance between that sensor and the surrounding wall of the borehole, and processing said signals to determine the curvature of the borehole in the vicinity of the sensors.

The sensors may be spaced equally or unequally apart longitudinally of the borehole. Preferably the sensors lie along a line extending substantially parallel to the axis of the elongate structure, so as to be located in the same angular position with respect to the axis.

The method may include the step of rotating the elongate structure about an axis extending longitudinally of the borehole and processing the signals from the sensors at a plurality of different rotational positions of the structure, or continuously, said signals being processed as a function of the rotational position of the structure to determine the curvature of the borehole in a plurality of different planes containing said rotational axis.

Preferably the method comprises the steps of determining at least the lateral curvature, and the curvature in a vertical plane, of the borehole.

The sensors may include at least one non-contact sensor which emits a signal towards the wall of the borehole, receives the signal reflected from the wall of the borehole and generates an output signal dependent on the time taken between emission and reception of the signal, and hence on the distance of the sensor from the wall of the borehole. For example, said sensor may be an acoustic, sonic or ultra-sonic sensor.

Alternatively, or additionally, the sensors may include a contact sensor having a mechanical probe projecting from the elongate structure and contacting the wall of the borehole, the sensor being adapted to generate an output signal dependent on the attitude or condition of the probe as affected by the distance of the elongate structure from the wall of the borehole. Contact and non-contact sensors may be combined in the same assembly. For example, a non-contact sensor may be located between two longitudinally spaced members which contact the wall of the borehole to locate the non-contact sensor with respect to the borehole.

In the method according to the invention the elongate structure on which the sensors are mounted may be liable to deflect while measurements are being taken, particularly of if the structure is rotating, and such deflection of the structure may introduce errors into the signals from the sensors.

In order to compensate for such errors, therefore, means may be provided for sensing deflections in the elongate structure, said means generating signals which are processed with the signals from the distance sensors in a manner to correct for such deflections when determining the curvature of the borehole. For example, the deflection sensing means may comprise strain gauges adapted to sense differential elongation of different regions of the elongate structure, from which deflections of the structure may be determined.

Alternatively, the elongate structure on which the distance sensors are mounted may be so mounted on another elongate downhole component as to be isolated from deflections of said downhole component. For example, the elongate structure may be mounted on the downhole component by a number of supports such that deflections of the downhole component are not transmitted by the supports to the elongate structure. Said supports may comprise connecting elements of low modulus of elasticity.

As previously discussed, according to a further aspect of the invention, the above-described methods of determining the curvature of a borehole may be employed to provide an input component in a directional drilling system.

The invention thus provides a novel method of controlling directional drilling equipment of the kind comprising a downhole drilling assembly incorporating a bias unit which is responsive to an input bias signal in a manner to control the direction of drilling in accordance with the bias signal. In prior art arrangements the bias signal is generally produced by measuring the direction of the borehole, comparing the measured direction with a desired direction, and sending to the bias unit bias signals to reduce or minimize the vector difference between the measured and desired directions of the borehole.

By contrast, according to the present invention, the bias signals are produced by measuring the curvature of the borehole, comparing the measured curvature with a desired curvature, and sending to the bias unit bias signals to reduce or minimize the difference between the measured and desired curvatures of the borehole.

The curvature of the borehole may be measured by any of the methods previously referred to.

As previously described, the actual curvature vector of the borehole can be measured, and in preferred embodiments can be measured in the vicinity of the drill bit and bias unit itself. Accordingly, the measurement of curvature can be more accurate and reliable than the measurement of direction in the prior art arrangements. As a result it becomes less necessary to average readings over time intervals, thus avoiding the difficulties previously referred to. Also, measurement of the curvature vector improves the stability of the control loop, since the phase of a curvature signal is 90° in advance of that of a directional signal.

The desired curvature may be determined and updated by measuring the direction of the borehole, comparing the measured direction with a desired direction, and determining the desired curvature which would reduce or minimize the difference between the measured and desired directions of the borehole.

In any of the above methods, the desired direction of the borehole may be at least partly determined by geosteering requirements as defined by formation evaluation equipment.

Thus, in any of the above arrangements, the desired direction of the borehole may be determined by the output of at least one downhole geophysical sensor which is responsive to a characteristic of a subsurface formation in the vicinity of the downhole assembly, said sensor providing an output signal corresponding to the current value of said characteristic, interpretation means being provided to provide said desired direction input in response to the output from the geophysical sensor so as to steer the borehole in an appropriate direction having regard to the characteristics of the formation through which the borehole is being drilled.

BRIEF DESCRIPTION OF DRAWINGS

The following is a more detailed description of embodiments of the invention, by way of example, reference being made to the accompanying drawings.

FIG. 1 is a diagrammatic representation of part of a downhole assembly showing a method of measurement of the curvature of the borehole.

FIG. 2 is a diagrammatic drawing of a downhole assembly incorporating the present invention.

DETAILED DESCRIPTION

Figure 3:
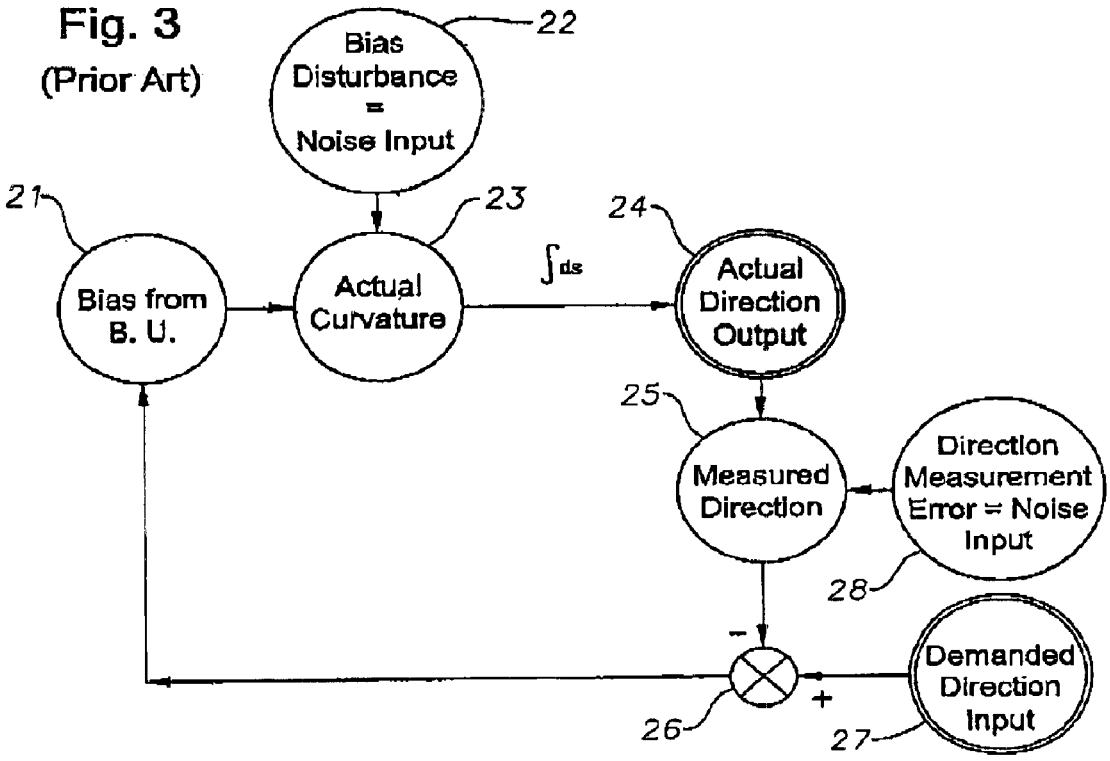
Fig. 3 (Prior Art)
FIG. 3 is a dependence diagram showing disturbance and noise inputs to a prior art directional drilling control loop.

Referring to FIG. 1, there is shown a curved section of a subsurface borehole 10 in which is located an elongate structure 11 forming part of a downhole assembly. As will be described, the structure 11 may comprise part of a directional drilling downhole assembly but the invention is not limited to this application and the structure 11 may be part of any other form of downhole assembly.

The structure 11 may comprise a tubular drill collar which may be non-rotatable, in the case where the drill bit is rotated by a downhole motor, but preferably the structure 11 is rotatable about an axis 12 which extends longitudinally of the borehole 10.

Three distance sensors 13, 14 and 15 are fixedly mounted on the structure 11 and spaced apart along the length thereof. The sensors 13 and 14 are separated by a longitudinal distance L and the sensors 14 and 15 are separated by a longitudinal distance M. All three sensors lie along a line extending parallel to the axis of rotation 12 of the structure 11, so that the sensors are all located in the same angular position about the axis 12.

In the arrangement shown in FIG. 1, by way of example, each sensor 13, 14, 15 is a non-contact sensor which is adapted to generate an output signal corresponding to the distance between the sensor and the part of the wall of the borehole 10 lying on a line which is normal to the axis 12 and passes through the respective sensor. For example, each sensor may incorporate an acoustic, sonic or ultra-sonic transmitter which emits a signal along said line so that the signal is reflected from the wall of the borehole and is detected by an appropriate detector in the sensor. The sensor determines the time delay between emission of the signal and detection of the reflection which time is, of course, related to the distance of the sensor from the wall of the borehole.

In FIG. 1 the distances of the respective sensors 13, 14 and 15 from the wall of the borehole are indicated as x1, x0, and x2 respectively. The sensors are then adapted to generate signals corresponding to x1, x0, and x2 to a downhole micro-processor (not shown) which processes the signals to produce a composite signal x where:

$$x = x_0 - \frac{Mx_1 + Lx_2}{L+M}$$

x is independent of lateral movements of the axis 12 towards and away from the wall of the borehole 10, including both translatory movement and tilt.

It will be appreciated that the composite signal x is a function of the rotational position of the structure 11 and sensors 13, 14 and 15. The rotational position of the sensors may be defined by a roll angle ψ from a datum rotational position, which is usually the position where the sensors are uppermost or at the "high side" of the structure.

Any other misalignment of the structure 11 and sensors 13, 14, 15 relative to the borehole, for example angular tilting of the structure, will have a constant effect on the composite signal such that the composite signal=x−X, where X is constant.

The curvature C(ψ) of the wall of the borehole at a roll angle ψ is given by:

$$c(\psi) = \frac{x(\psi) - X}{LM} = a_0 + a\mathrm{Cos}\psi + b\mathrm{Sin}\psi + a_2\mathrm{Cos}2\psi + b_2\mathrm{Sin}2\psi + \ldots$$

$$x(\psi)=X+LMa_0+LMa\ \mathrm{Cos}\ \psi+LMb\ \mathrm{Sin}\ \psi+\text{harmonics}$$

Harmonics are due to out of roundness of the borehole 10. Fourier analysis may be employed to determine a, b and eliminate or measure harmonics.

$$a = \frac{1}{LM\pi}\int_0^{2\pi} x\mathrm{Cos}\psi d\psi = \frac{2}{LM}\cdot\mathrm{mean}(x\mathrm{Cos}\psi)$$

$$b = \frac{1}{LM\pi}\int_0^{2\pi} x\mathrm{Sin}\psi d\psi = \frac{2}{LM}\cdot\mathrm{mean}(x\mathrm{Sin}\psi)$$

It should be noticed that the integrals are with respect to roll angle (ψ) and not with respect to time. If the structure 11 rotates at a constant speed then roll angle (ψ)=2π Nt, where N is a constant. However, as is well known, components rotating in borehole are often subject to "slip-stick" where periods where the component is non-rotating alternate with periods of rotation during which the rate of rotation may also vary. For the purposes of processing the signals from the sensors to give the curvature, therefore, it may usually be necessary to measure the actual value of the roll angle (ψ) for the analysis to be carried out by the processor. A roll angle sensor (not shown), of any suitable known type, is mounted on the downhole structure 11 for this purpose.

For the purposes of determining the curvature of the borehole in space, it is desirable to measure both build curvature, i.e. the curvature in a vertical plane, and lateral curvature.

$$\text{Build curvature} = \frac{d\theta}{dS} = a$$

$$\text{Lateral curvature} = \mathrm{Sin}\theta\frac{d\phi}{dS} = b$$

-continued $$\text{Azimuth rate} = \frac{d\phi}{dS} = \frac{b}{\mathrm{Sin}\theta}$$

Where:

θ=inclination from vertical=90°+tilt

ϕ=azimuth

ψ=roll angle from high side

S=depth measured along axis

Thus, the arrangement shown in FIG. 1 allows the vertical and lateral curvature of the borehole 10 to be determined by using the sensors 13, 14, 15 by delivering their signals and a roll angle signal (provided by the roll angle sensor on the structure 11) to a suitably programmed micro-processor to carry out the analysis referred to above, the micro-processor providing an output corresponding to the two components of curvature of the borehole in the relevant planes.

Instead of the non-contact distance sensors described in relation to FIG. 1, contact sensors may be employed where the sensor incorporates an element which contacts the wall of the borehole as the structure 11 rotates, in a manner to generate a signal dependent on the distance of the structure from the wall. For example, the sensor may incorporate a spring-loaded contact probe which contracts and extends with variation of the distance of the sensor from the wall of the borehole, the extension and contraction of the probe being arranged to generate an appropriate distance signal. Non-contact sensors and contact sensors can be combined in the same assembly. For example, a contact skid on the structure may be combined with two non-contact sensors or two skids may be combined with a single non-contact sensor.

One form of downhole assembly incorporating the invention is shown in FIG. 2. In this arrangement the downhole assembly 16 incorporates a flexible elongate collar 17, a bias unit 18, and a collar 19 between the bias unit 18 and flexible collar 17, the collar 19 housing the control unit for controlling the bias unit 18. The drill bit itself is indicated diagrammatically at 20. A stabilizer 121 is located between the collar 19 and the flexible collar 17. In such case the flexible collar 17 itself curves to conform generally to the curvature of the borehole which has been drilled by the bit 20.

The collar 19 constitutes the elongate structure on which are mounted longitudinally spaced sensors 122, 123, 124 which, as in the arrangement of FIG. 1, determine the distance of different parts of the collar 19 from the wall of the borehole, thus allowing the curvature of the borehole to be determined, as previously described.

In this case, however, strain gauges 125 are mounted on the collar 19 and generate signals which are processed with the signals from the distance sensors so as to correct for deflection of the collar 19 under the stresses to which it is subject during drilling. It is particularly necessary to correct for deflections in the elongate structure on which the distance sensors are mounted in cases where the flexible collar 17 is omitted, since this tends to increase the bending moments in the elongate structure.

Although the distance sensors will normally lie along a line extending parallel to the axis of rotation of the elongate structure on which they are mounted, so that the sensors are all located in the same angular position about the axis, in some applications of the invention two or more of the sensors may be located at different angular positions. For example, each sensor may be replaced by a plurality of sensors spaced angularly apart about the periphery of the elongate structure.

The methods according to the invention for measuring the curvature of a borehole may have many uses in subsurface drilling. For example, a component may be passed longitudinally down a pre-drilled borehole in order to measure the tortuosity of the borehole. This information may be useful either to make the operator aware of any constraints which the tortuosity of the borehole may impart, or, for example, to determine whether or not a particular borehole complies with the standards contracted for by the drilling operator.

However, as previously discussed, the major application of the invention is to the use of measurement of borehole curvature, while drilling, as an input for the control of a directional drilling bias unit.

FIG. 3 is a dependence diagram for a common prior art form of control of direction by bias dependent on measured and desired direction.

Referring to FIG. 3, the bias applied to the bottom hole assembly by the bias unit is indicated at 21. The curvature 22 of the borehole resulting from the bias 21 is also affected by other factors causing bias disturbance or "noise" as indicated at 22. For example, the bias may be varied as a result of variations in the nature of the formation through which the drill bit is passing. The bias applied by the bias unit in combination with the "noise" input 22 results in an actual curvature of the borehole as indicated at 23. The direction 24 of the borehole is measured as indicated at 25. The measured direction is then compared, as indicated at 26, with a demanded direction input 27 and an appropriate control signal is sent to the bias unit to apply a bias 21 in a direction to reduce or minimize the discrepancy between the measured direction 25 and the demanded direction input 27.

However, the measured direction of the borehole is subject to error, as indicated at 28, due to errors in measurement and noise. The noise may be due, for example, to vibration of the drill collar in the hole, magnetic disturbances, temperature fluctuations, servo and other instrument errors etc. As previously mentioned, in order to minimize the effect of noise the direction of the borehole is measured at intervals and an average taken, thus introducing a lag into the control. Measurement of the direction of the borehole also gives rise to other difficulties, as previously discussed.

Figure 4:
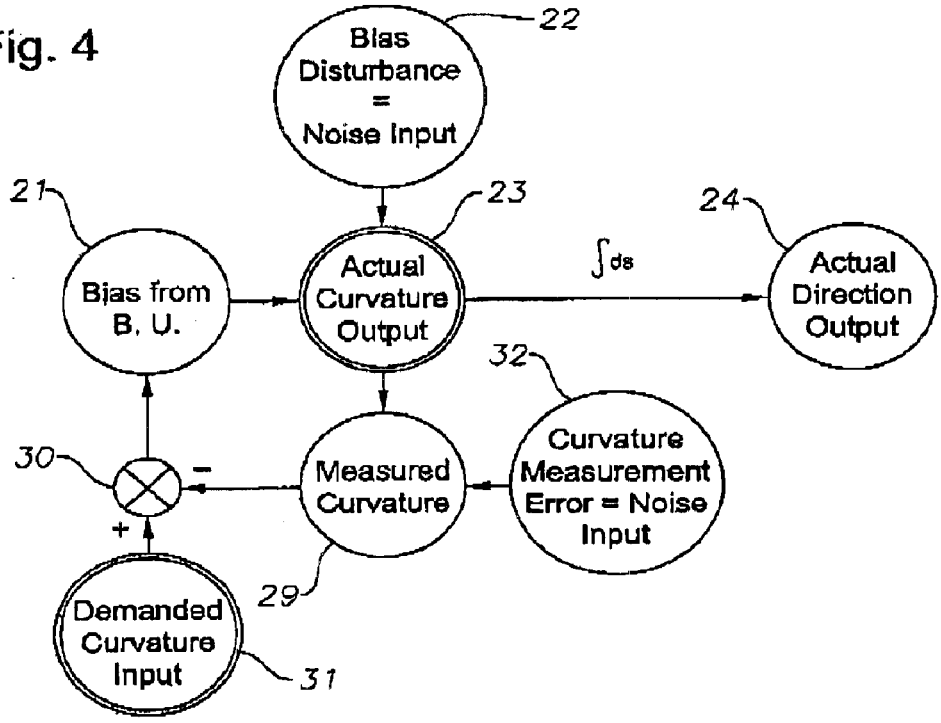
FIG. 4 is a dependence diagram for a method of controlling curvature in a directional drilling assembly according to the present invention.

FIG. 4 shows a modified control method according to the present invention, in which the bias controlling the drilling direction is dependent only on measured and demanded curvature. Components of the method corresponding to the prior art method of FIG. 3 bear the same reference numerals.

In this arrangement according to the invention, the actual curvature 23 of the borehole is measured as indicated at 29, using any of the methods of curvature measurement previously described. The measured curvature 29 is compared, as indicated at 30, with a demanded curvature input 31 and the bias 21 provided by the bias unit is controlled to reduce or minimize the difference between the measured curvature and the demanded curvature input.

The measured curvature is subject to measurement error and noise as indicated at 32, but since it is curvature of a specific part of the borehole which is being measured, rather than the direction of the borehole, the effect of measurement errors and noise is less than in the case of measurement of direction and also the phase lag caused by the necessity of averaging the direction measurement is avoided. The phase of a curvature signal is 90° in advance of that a directional signal, and a tighter control loop is therefore possible.

Figure 5:
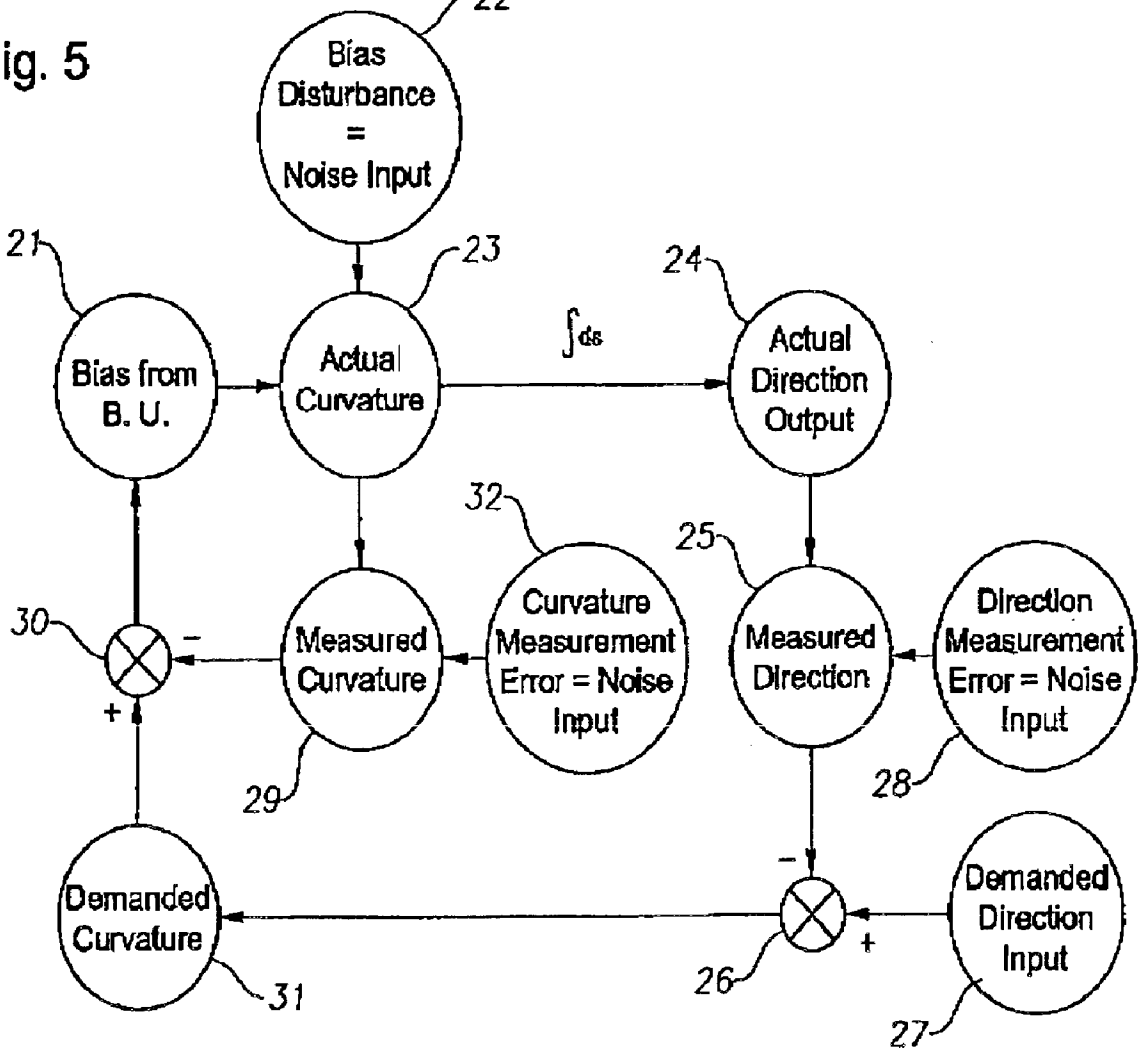
FIG. 5 is a dependence diagram for a preferred method according to the present invention.

In the preferred embodiments of the invention feedback of borehole curvature to the bias vector, in accordance with the invention, may be combined with feedback of direction to the bias vector, and this is shown diagrammatically in FIG. 5.

Figure 6:
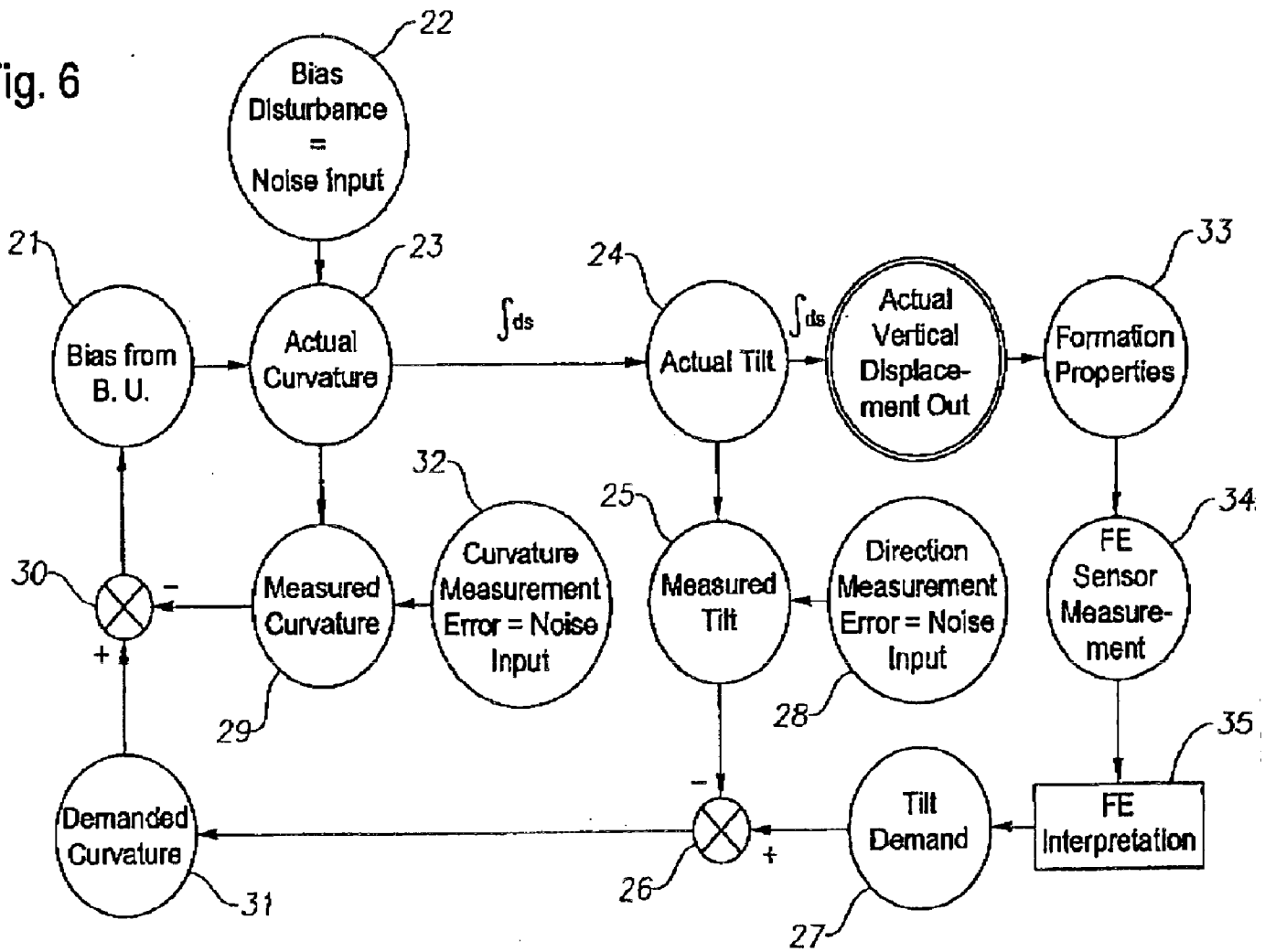
FIG. 6 is a similar view to FIG. 4 showing a development of the method according to the invention.

It has been proposed, in directional drilling systems, to use formation evaluation data as an input for the control of a directional drilling system so that the direction in which the borehole progresses takes into account the nature of the surrounding formation. Such an arrangement may, for example, enable the path of the borehole being drilled to be automatically and accurately controlled to be the optimum path given the nature of the surrounding formation. For example, it frequently occurs that a borehole is required to extend generally horizontally through a comparatively shallow reservoir of hydrocarbon-bearing formation. Downhole formation evaluation sensors may locate the upper and lower boundaries of the reservoir and the input from the sensors into the control of the bias unit may then be used automatically to maintain the drill bit at an optimum level between the upper and lower boundaries. FIG. 6 shows diagrammatically the application of such geologic steering to the control method according to the present invention.

In this version of the invention, downhole geophysical sensors measure the geological properties 33 of the formation, as indicated at 34. These measurements are interpreted, as indicated at 35, to produce the demanded direction input or tilt demand 27, instead of such demand being provided by an operator at the surface or by a downhole computer program controlling the drilling.

Figure 7:
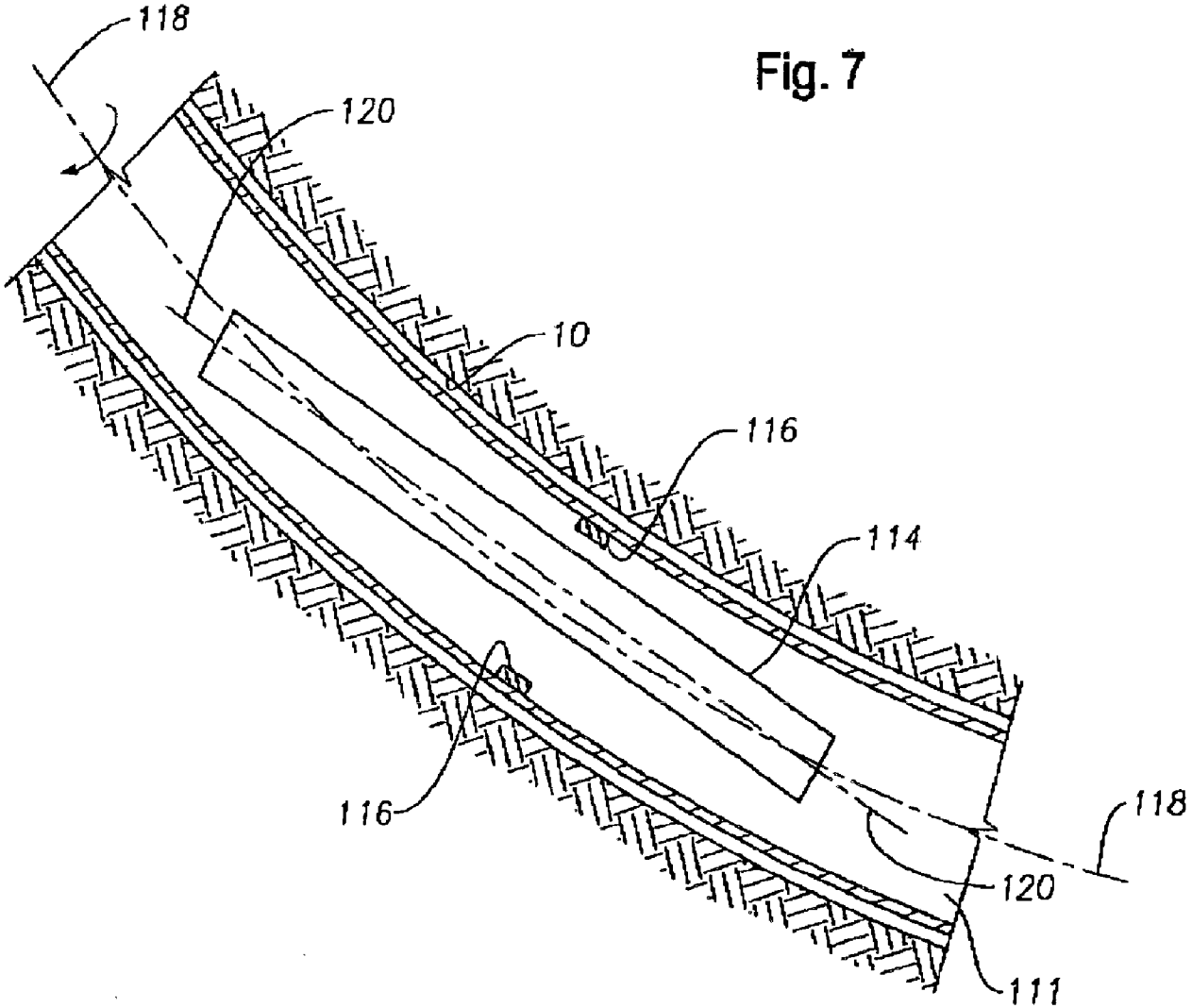
FIG. 7 is a diagrammatic representation of part of a downhole assembly showing an alternative method of measurement of the curvature of the borehole.

In another embodiment shown in FIG. 7, an elongated structure 111 has an internal control unit 114 which is a roll stabilized platform used to physically instrument the tool face coordinate frame. The control unit 114 is suspended in the structure 111 as it flexes in following the curvature of the borehole 10. The structure 111 therefore has a curved axis 118 which corresponds to the curvature of the borehole 10, while the control unit 114 has a straight axis 120. Because the control unit 114 is a roll stabilized platform, it remains stationary with respect to the earth while the structure 111 rotates about it while drilling.

At least one magnet 116 is mounted in the structure 111. Preferably, however, two or more magnets 116 are spaced apart in the structure 111, and preferably mounted diametrically opposed. The changing magnet field is measured within the control unit 114 as the structure 111 rotates about it for the purposes of determining the instantaneous angular orientation and rate of the control unit 114 with respect to the structure 111.

The measuring may be achieved by two orthogonal magnetometers (not shown) mounted in the control unit 114 perpendicular to the roll axis. The strength of the signal output is a monotonic function of its separation from the magnets 116. When the system is drilling a straight hole, the relative loci of the magnetometers with respect to the magnets 116 is such that they produce a certain minimum and maximum signal.

When the structure 111 is curved, this loci of relative motion changes and so does the minimum and maximum excursion of the sensed signals. By the appropriate signal processing and calculations, as previously described, both the magnitude and toolface of the curvature can be extracted without needing to know the rate of penetration and other factors previously thought necessary.

In the embodiment shown in FIG. 7, the magnets act in a manner to the previously described sensors, and the locations and orientations of the magnets may be adjusted in various arrangements similar to the sensors shown in FIGS. 1 and 2 to make various specific types of measurements.

A very useful result of this embodiment is that a measurement of rate of penetration (ROP) can be calculated directly. Dynamic ROP measurement was previously very difficult to determine while drilling. If the onboard sensors measuring the angular orientation of the structure 111 are differentiated with respect to time, ROP can derived as follows:

$$ROP = \frac{dm}{dt} = \frac{d\theta}{dt} * \frac{dm}{d\theta} = \frac{\text{angular_rate}(\text{deg/hr})}{dogleg\,(\text{deg/m})}$$

Whereas the present invention has been described in particular relation to the drawings attached hereto, it should be understood that other and further modifications apart from those shown or suggested herein, may be made within the scope and spirit of the present invention.

What is claimed is:

1. A method of measuring a curvature of a subsurface borehole having a surrounding wall comprising locating in the borehole an elongate structure having mounted thereon at least three distance sensors spaced apart longitudinally of the borehole, each distance sensor being adapted to produce an output signal corresponding to a distance between that sensor and the surrounding wall of the borehole, and processing said signals to determine the curvature of the borehole in the vicinity of the sensors further comprising means for sensing deflections in the elongate structure, said means generating signals which are processed with the signals from the distance sensors in a manner to correct for such deflections when determining the curvature of the borehole.

2. A method according to claim 1, wherein the sensors are equally spaced apart.

3. A method according to claim 1, wherein the sensors are unequally spaced apart.

4. A method according to claim 1, wherein the sensors lie along a line extending substantially parallel to an axis of the elongate structure, so as to be located in the same angular position as one another with respect to the axis.

5. A method according to claim 1, further including a step of rotating the elongate structure about an axis extending longitudinally of the borehole and processing the signals from the sensors, said signals being processed as a function of the rotational position of the structure to determine the curvature of the borehole in a plurality of different planes containing said rotational axis.

6. A method according to claim 5, wherein the signals from the sensors are processed at a plurality of different rotational positions of the structure.

7. A method according to claim 5, wherein the signals from the sensors are processed continuously.

8. A method according to claim 1, wherein the method further comprises the steps of determining at least the lateral curvature, and the curvature in a vertical plane, of the borehole.

9. A method according to claim 1, wherein the sensors include at least one non-contact sensor which emits a signal towards the wall of the borehole, receives the signal reflected from the wall of the borehole and generates an output signal dependent on the time taken between emission and reception of the signal, and hence on the distance of the sensor from the wall of the borehole.

10. A method according to claim 9, wherein said sensor is one of an acoustic, a sonic and an ultra-sonic sensor.

11. A method according to claim 1, wherein the sensors include a mechanical probe projecting from the elongate structure and contacting the wall of the borehole, the sensor being adapted to generate an output signal dependent on the attitude or condition of the probe as affected by the distance of the elongate structure from the wall of the borehole.

12. A method according to claim 1, wherein the deflection sensing means comprises strain gauges adapted to sense differential elongation of different regions of the elongate structure, from which deflections of the structure may be determined.

13. A method according to claim 1, wherein the elongate structure on which the distance sensors are mounted is so mounted on another elongate downhole component as to be isolated from deflections of said downhole component.

14. A method according to claim 13, wherein the elongate structure is mounted on the downhole component by a number of supports such that deflections of the downhole component are not transmitted by the supports to the elongate structure.

15. A method according to claim 14, wherein said supports comprise connecting elements of low modulus of elasticity.

16. An apparatus for use in measuring a curvature of a subsurface borehole comprising an elongate structure having mounted thereon at least three distance sensors spaced apart longitudinally of the borehole, in use, each distance sensor being adapted to produce an output signal corresponding to a distance between that sensor and the surrounding wall of the borehole and further comprising means for sensing deflections in the elongate structure.

17. An apparatus according to claim 16, wherein the sensors are equally spaced apart.

18. An apparatus according to claim 16, wherein the sensors are unequally spaced apart.

19. An apparatus according to claim 16, wherein the sensors lie along a line extending substantially parallel to an axis of the elongate structure, so as to be located in the same angular position with respect to the axis.

20. An apparatus according to claim 16, wherein the sensors include at least one non-contact sensor which emits a signal towards the wall of the borehole, receives the signal reflected from the wall of the borehole and generates an output signal dependent on the time taken between emission and reception of the signal, and hence on the distance of the sensor from the wall of the borehole.

21. An apparatus according to claim 20, wherein said sensor comprises one of an acoustic, a sonic and an ultra-sonic sensor.

22. An apparatus according to claim 16, wherein the sensors include a contact sensor having a mechanical probe projecting from the elongate structure and contacting the wall of the borehole, the sensor being adapted to generate an output signal dependent on the attitude or condition of the probe as affected by the distance of the elongate structure from the wall of the borehole.

23. An apparatus according to claim 16, wherein said deflection sensing means comprises strain gauges adapted to sense differential elongation of different regions of the elongate structure, from which deflections of the structure may be determined.

24. An apparatus according to claim 16, wherein the elongate structure on which the distance sensors are mounted is so mounted on another elongate downhole component as to be isolated from deflections of said downhole component.

* * * * *